US007281281B2

(12) United States Patent
Langenberger

(10) Patent No.: US 7,281,281 B2
(45) Date of Patent: Oct. 16, 2007

(54) DUST RUFFLE STABILIZER

(76) Inventor: Nancy Langenberger, 3541 Park Blvd., #107, San Diego, CA (US) 92103

( * ) Notice: Subject to any disclaimer, the term of this patent is extended or adjusted under 35 U.S.C. 154(b) by 0 days.

(21) Appl. No.: 11/228,415

(22) Filed: Sep. 15, 2005

(65) Prior Publication Data

US 2007/0056099 A1 Mar. 15, 2007

(51) Int. Cl.
*A47G 9/04* (2006.01)

(52) U.S. Cl. ..... 5/493; 5/486

(58) Field of Classification Search ..... 5/493, 5/486, 487; 108/90
See application file for complete search history.

(56) References Cited

U.S. PATENT DOCUMENTS 2,763,875 A * 9/1956 Piontkowski ..... 5/493
3,654,059 A * 4/1972 Zisblatt ..... 428/41.5
4,141,097 A 2/1979 Levinsohn et al.
4,402,098 A 9/1983 McClam
4,682,379 A 7/1987 Dugan
4,985,953 A 1/1991 Seago
5,205,003 A * 4/1993 Green ..... 5/493
5,271,112 A 12/1993 Bible et al.
5,733,397 A * 3/1998 McDaniel ..... 156/66
5,749,110 A * 5/1998 Gamble et al. ..... 5/493
5,946,750 A * 9/1999 Shiu ..... 5/502
6,823,544 B2 11/2004 Treece
6,886,197 B1 * 5/2005 Madigan ..... 5/482

* cited by examiner

*Primary Examiner*—Michael Trettel
(74) *Attorney, Agent, or Firm*—Harris Brotman

(57) ABSTRACT

A dust ruffle stabilizer having a flexible covering for a foundation or box spring. Side sections of the covering include adhesive for removably engaging a corresponding inner side of a skirt of a bed skirt against the adhesive surface the side section.

6 Claims, 4 Drawing Sheets

DUST RUFFLE STABILIZER

BACKGROUND OF THE INVENTION

1. Field of the Invention

This invention relates to a covering which stabilizes a dust ruffle or bed skirt on a foundation, in particular, on a box spring.

2. Description of Related Art

Conventional bed skirts or dust ruffles are commonly used in connection with box spring and mattress sets for beds. The dust ruffle's skirting material is permanently attached by conventional means, such as sewing or bonding, to a flat sheet. Dust ruffles are often installed about the perimeter of a bed for decorative purposes, typically installed to span the distance between the ground and the bed's box spring or other mattress foundation. The foot and sides of a standard bed, and three or all four sides of a bed are often covered by a dust ruffle. Dust ruffles help prevent the gathering of dust under the bed.

Especially in the home, conventional box spring covers are generally fabricated of a material to match the comforter and draperies of the bedroom; often, the dust ruffle is formed integrally with the box spring cover. Box spring covers and dust ruffles for home use are typically either made according to a standard size, or custom made to fit a specific bed.

Conventional dust ruffles and box spring covers are made from flat sheeting and permanently attached skirting material. Because the flat sheeting, the box spring surface, and lower surface of a mattress have smooth surfaces, the flat sheeting material slips and slides in between the mattress and box spring causing the bed skirt to lose its alignment. This is particularly so where the dust ruffle hangs from between the mattress and the box spring, and is easily disturbed by the changing of the bedsheets, and must then be repositioned to provide the desired appearance. In addition, some conventional dust ruffles and box spring covers may require removal of the mattress for repositioning of the dust ruffle and flat sheet.

Typically, these bed skirts consist of a flat platform sheeting material that is attached to a skirt portion, the skirt portion being formed from a single piece of fabric. The platform sheeting material may be permanently attached or releasably attached to the skirt portion. The platform sheeting material is sandwiched between a mattress and a mattress foundation, such as a box spring.

The bed skirt uses the weight of the mattress to pin the platform sheeting material between the mattress and the box spring in order to maintain its position and to allow the skirt portion to extend around at least a substantial portion of the perimeter of a box spring.

A conventional bed skirt typically includes a support or platform panel which is dimensioned to overlay the upper surface of the mattress foundation, such as a box spring, and which supports a skirt portion at its edges. The skirt portion extends around at least a substantial portion of the perimeter of the mattress foundation and extends downwardly such that the lower edge of the skirt portion terminates at or proximate the floor on which the associated bed is supported Certain prior art bed clothing devices and systems are disclosed in U.S. Pat. Nos. 5,271,112; 4,985,953; 4,682,379; 4,402,098; and 4,141,097.

A disadvantage of conventional dust ruffles is that they require constant readjustment of the dust ruffle when the bed is made. First, since the mattress, box spring, and platform sheeting material all have smooth surfaces, the weight of the mattress alone is not sufficient to keep the platform sheeting material stabilized so that the attached skirt portion remains properly draped in an effective alignment with the floor.

SUMMARY OF THE INVENTION

The present invention is directed to a flexible covering for a platform, such as a box spring. The covering comprises a platform section which is configured and dimensioned for overlaying the top and edges of the platform. The covering comprises side sections extending from the periphery of the platform section, which descending adjacent to the sides of a platform, and terminate in lower edge. Surfaces of the side sections comprise adhesive for removably engaging a corresponding inner side of a skirt of a bed skirt against the adhesive surface the side section. The covering has embodiments which include coverings for box springs, tables, couches. Certain embodiments of the covering comprise elastic in the lower edges of the side sections and/or contouring of the corners of the covering for fitting the covering to the foundation.

DETAILED DESCRIPTION

Figure 1:
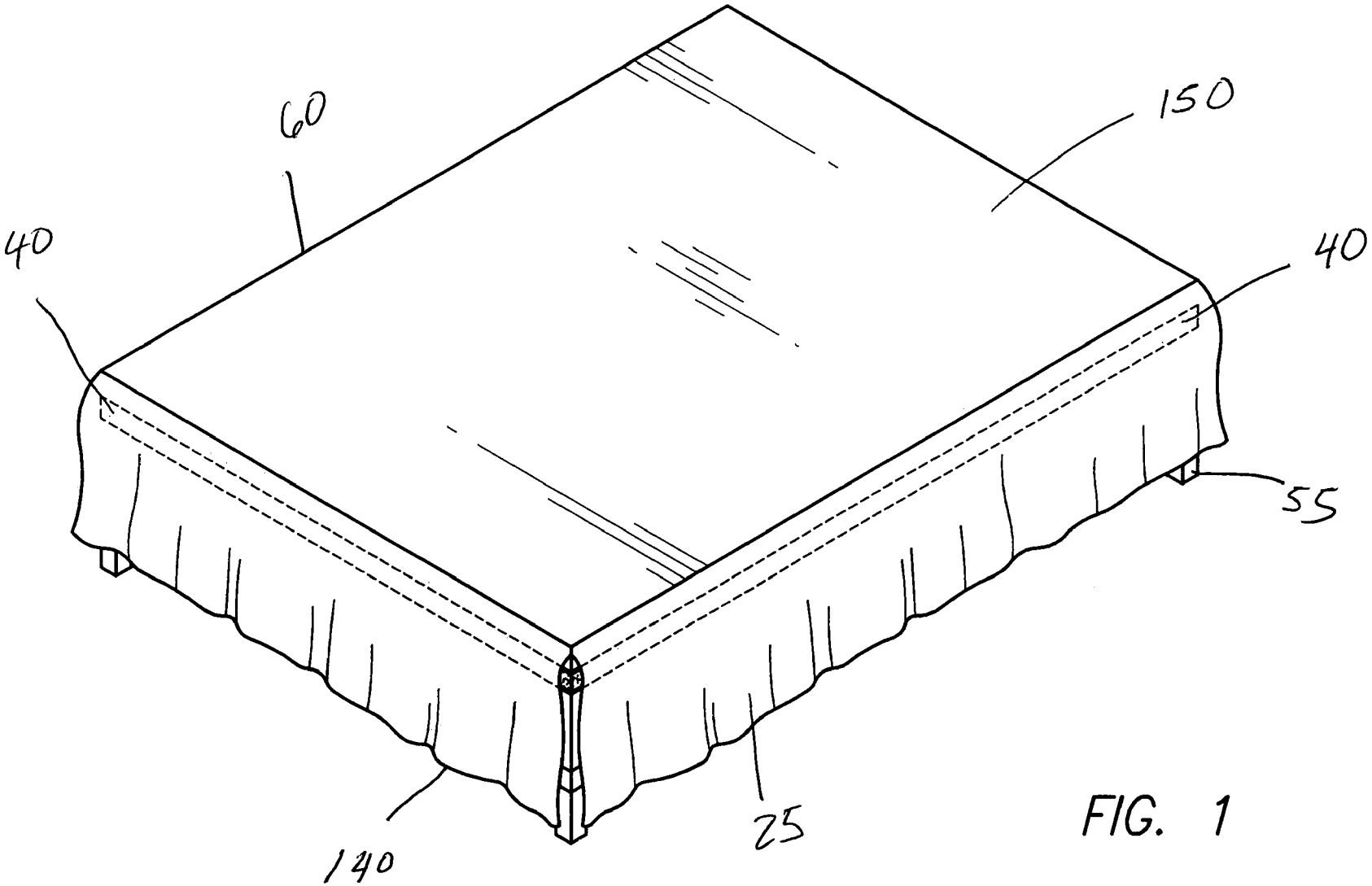
FIG. 1 is a perspective view of a bed skirt stabilized by the adhesive area, drawn in phantom.

The present invention is a covering 10 for a box spring 15 or other foundation for securing/stabilizing a conventional bed skirt 20 to a box spring 15 or other support foundation so that the skirts 25 of the bed skirt are maintained in proper drape relation to the floor, stabilized in place below the mattress.

The present invention relates to a box spring covering 10 which is removably attached or positioned between a mattress and its supporting structure 15 (e.g. box spring or bed board).

The side sections 45 of the covering 10 comprising adhesive material 40, upon which the inner surfaces 5O of the skirts 25 of a conventional bed skirt 20 or dust ruffle are removably adhered. The dust ruffle 20 is fitted over the covering 10 of the invention. The adhesive side walls 45 of the covering sufficiently adhere the inner surface(s) 50 of the dust ruffle to maintain the proper position of the dust ruffle below the mattress and adjacent the exposed sides 120 of the box spring 15. i.e. wherein the skirt 25 of the dust ruffle 20 is maintained in its proper position adjacent the exposed sides 120 of the box spring.

Referring to FIGS. 1-4, the embodiments of the present invention relate to a bed of standard known design. The bed generally comprises a bed frame 55, a box spring 15 or other mattress foundation, and a mattress. The bed is depicted as rectangular, having a head end, a foot end, a first side, and a second side. It will be understood by those of ordinary skill in the art, however, that the present invention is equally applicable to use with beds of other shapes. It will also be understood that the present invention is applicable to use with beds of standard sizes (i.e., twin, full, queen, king, California king), irregular sizes, and different configurations.

Figure 2:
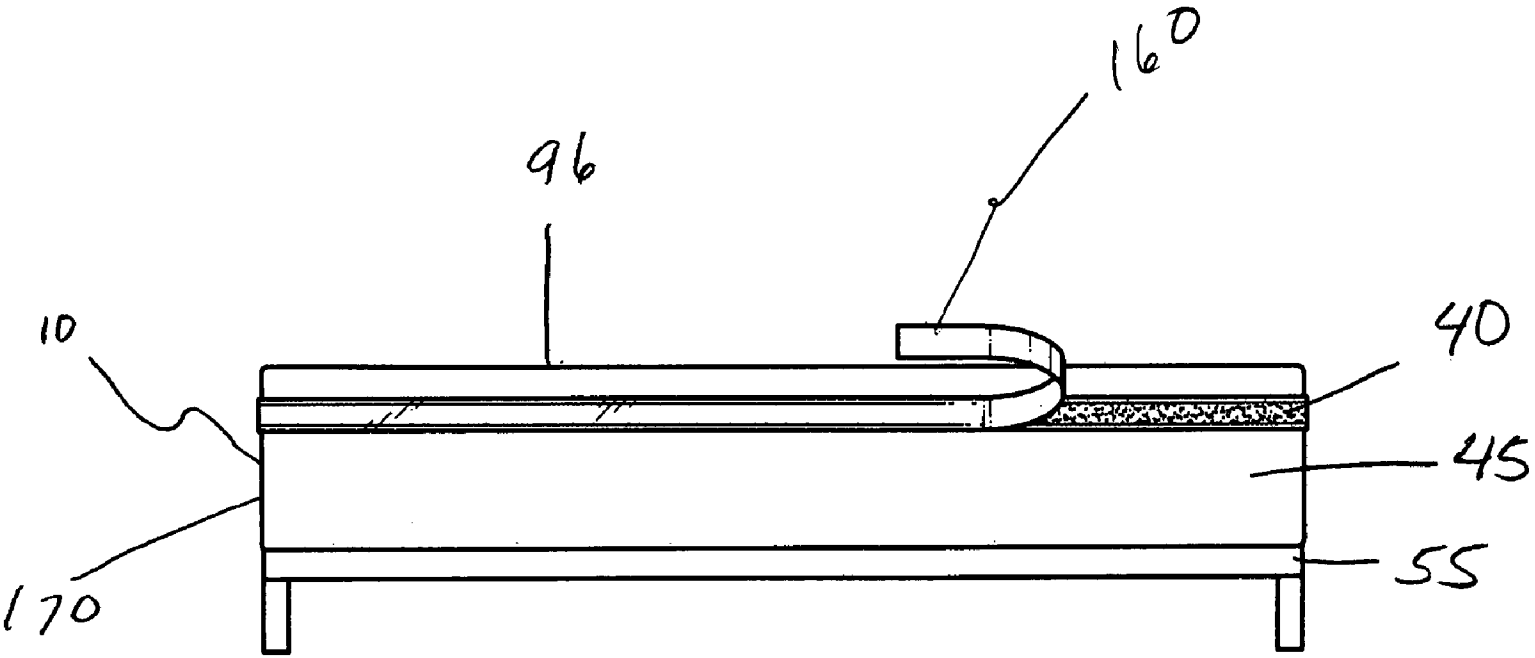
FIG. 2 is a side perspective view of the covering in place on a box spring.
Figure 4:
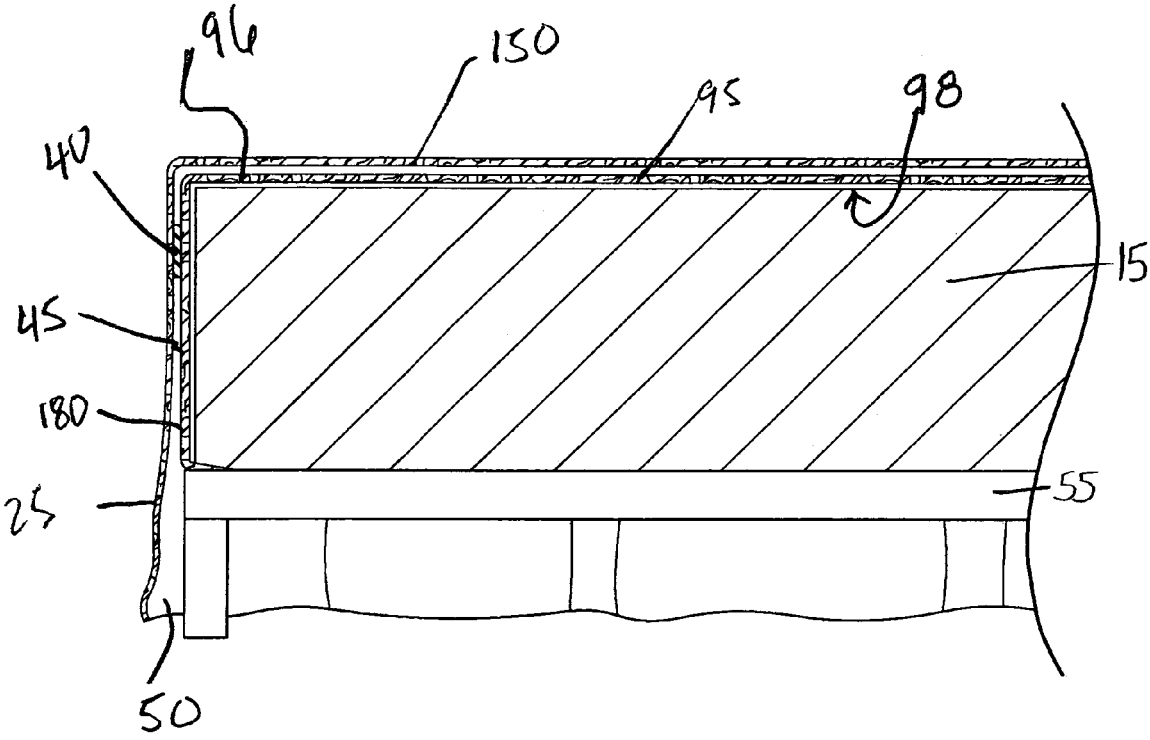
FIG. 4 is a sectional view of the covering fitted over a box spring and a bed skirt fitted over the covering and stabilized by the adhesive area.

FIGS. 1, 2 and 4 show a dust ruffle 20 installed on a portion of a bed, draped over the box spring. The dust ruffle generally comprises three separate skirt panels 25: a first panel adjacent the foot end of the bed; a second panel adjacent the first side of the bed; and a third panel adjacent the second side of the bed. A fourth panel (unshown) can also be provided adjacent the head end of the bed, if desired. Typically, the provision of a fourth panel will be unnecessary for standard beds including a headboard, or bed which are placed with the head end against a wall or other structure. The provision of a fourth panel will generally be desirable for beds having all four sides exposed.

Figure 3:
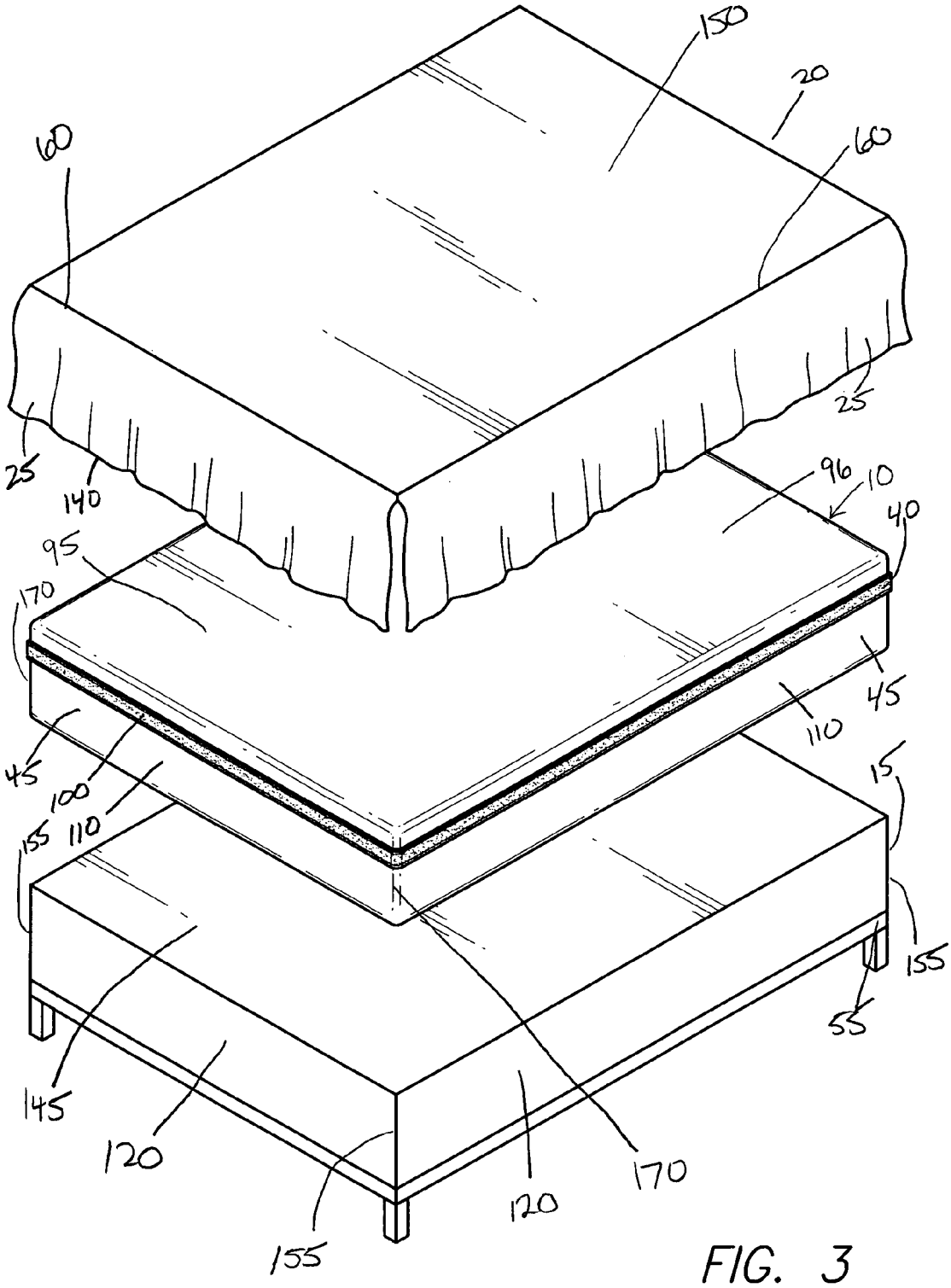
FIG. 3 illustrates the placement of the covering between a box spring and a bed skirt.

One aspect of the covering of the present invention is shown in full perspective in FIG.3. The covering includes a platform 95 , preferably a flexible sheet constructed of a suitable textile or linen material. Depending from each end and side of platform are adhesive side walls 45.

An embodiment of the present invention illustrated in FIGS. 2, 3 and 4 is a fitted box spring covering 10. The covering 10 includes a first side wall 45, a second side wall 45 and end walls 45. The platform 95 and walls 45 may be constructed as continuous sheets of textile or linen material, or alternatively may comprises netted, webbed or other open structure of varying elasticity.

Fitted onto a box spring 15 on which the covering 10 of the invention is in use, the inner surface 50 of the side skirts 25 of the dust ruffle 20 adhere to the adhesive surface of the first, second and one or both end walls wall(s), which are in adjacent relation to the outer surfaces of the exposed sides of box spring 120. As illustrated in FIG. 3, the skirt portion 25 of the conventional bed skirt 20, when the mattress is removed from the mattress foundation, can be easily installed over the covering of the invention. The inner surfaces 50 of the skirts 25 are pressed against the adherent (adhesive) surface 40 of the side section 45, thereby engaging the inner surface 50 of the skirt 25 against the adherent side section, 40. To remove the bed skirt 20, the mattress is removed, and the bed skirt is simply disengaged by disengaging by pulling the inner surfaces of the skirts from the adherent surfaces of the side sections.

Definitions

"Conventional dust ruffle." Conventional dust ruffles 20 general require a deck section 150 top roughly the geometric configuration of the surface on which it is placed, the deck top supporting the descending skirts 25. The conventional bed skirt or dust ruffle includes a deck section 150 which is dimensioned to overlay the upper surface 145 of the mattress foundation 15, and which supports skirt portions 25 at its edges 60.

In the case of a bed, the lower surface of the platform section 95 of the covering 10 of the invention would be placed on the box spring 15 and have roughly the same configuration as the bed spring surface. In the case of a table, couch, or sofa, the dust ruffle would be similarly supported and have substantially the same configuration as the underlying object.

It is well known that many furniture items, such as sofas, chairs and furniture covers, are made with dust ruffles for the purpose of an attractive appearance, and prevention of dust collection therebeneath. In some situations, such as on upholstered furniture, they are permanently attached, while in other situations, such as around bed box springs or the like, they may be detachably attached thereto, by means of pins, in order to be removable for purposes of laundering.

In a conventional dust ruffle 20, the skirt portion 25 is fabricated of a cloth or fabric material. The length L of the skirt portion may selectively vary depending upon the bed to which it is affixed. However, the length L is preferably selected such that the lower edge of the skirt portion is positioned at or proximate the floor on which the associated bed is supported such that the skirt portion serves as an effective barrier to dust laden air.

A conventional box spring cover has a horizontal rectangular top portion between the mattress and the box spring that engages substantially the entire upper surface of said box spring and also has vertical marginal portions covering the entire surface of the side walls and an end wall of the box spring. Extending inwardly from the bottom edges of the marginal portions substantially throughout the lengths thereof are horizontal bottom portions that are adapted to slide over the box spring for detachably holding the covering on the box spring.

A sheet is bed clothing which comprises a thin layer of material adapted to directly overly or to directly underlay an occupant of the bed.

Foundation 15

The foundation 15 is generally planar and firm, removably positioned below a mattress. Beds commonly comprise a box spring foundation which supports a mattress thereon. However, it is not uncommon for a bed to comprise a pair of stacked mattress with a lower mattress serving as the foundation for an upper mattress. Therefore, for purposes of this application, the term "foundation" is intended to include a box spring, mattress, or other foundation structure which serves to support the mattress of a bed. The foundation defines a rectangular configuration having first, second, third and forth side portions.

The rectangular box spring has a horizontal upper surface 145 and vertical side and end portions 120, and normally supports a rectangular mattress on its upper surface 145 with the side and end sections of the mattress vertically aligned with the side and end portions walls 120 of the box spring.

Although the invention will be described and illustrated with respect to a conventional foundation of rectangular configuration, it is readily apparent that the subject invention is also applicable to foundations of different configurations, such as round.

Installation of the Covering and a Bed Skirt

Once the covering 10 of the invention is installed on a foundation 15, a bed skirt 20 is installed over the covering.

The conventional bed skirt 20 comprises a flat, basically rectangular sheet of cloth, i.e. a deck section 150, having a border of material extending downwardly along the sides from the edges 60 of the deck 150, which supports the downwardly extending material or skirt 25. The deck 150 sheet is usually dimensioned to fit over a conventional or box spring, such that the edges 60 of the deck sheet 150 are flush with the box spring enabling the skirt section 25 to merely hang downwardly from the sides of such deck sheet.

The deck sheet section 150 of a conventional bed skirt 20 must be placed directly onto the upper surface 145 of a foundation or box spring in order to properly position the skirt portions 25 along the perimeter or partial perimeter of a bed.

The covering 10 of the invention is easily installed by placing the platform section 95 onto the upper surface 145 of a foundation. The platform section 95 is sized and dimensioned to fit the size foundation. In certain embodiments, the side walls 45 of the covering 10 are sized and dimensioned to fittingly engage all four corners 155 of the foundation. Accordingly, when the covering 10 is fitted to the foundation, the adhesive side panels 40, 45 are positioned alongside the side portions 120 of the foundation. In those embodiments in which a protective layer of material 160 adheres to the adhesive side walls, the protective layer is removed, which exposes the adhesive 40 on the outer side 70 of a side wall 45. The deck sheet 150 of a dust ruffle is then fitted over the covering. The inner surfaces 50 of the skirts are then attached around the side portions of the foundation by pressing the outer surface 165 of the skirt 25 so that the inner surface 50 of the skirt is detachably attached against the adhesive surface 40, the side walls 45 anchored in place by the stable fit of the covering to the foundation.

Fitted Covering

Embodiments of the covering involve contoured or fitted configurations in which the corners 170 of the covering are formed to surround the corners 155 of a box spring, thereby improving the conformity or fit of the covering to the foundation, which stabilizes the covering on the box spring. The fitted covering has corners which are adapted to fit on and around the corners of the box spring, and in certain embodiments, elastically bias around and under the lower four corners of a box spring.

Contoured or fitted coverings include an elastic strip disposed in or around the bottom of the corners of the sheet to create pockets which fit around the four corners of a box spring. A contoured or fitted covering is dimensioned so that in position on the box spring it is stretched taut across the top and corners of the box spring. Elastic elements are joined around at least a portion of the lower edge of the cover to enable the one-piece fitted covering structure to substantially conform to the shape of a box spring, which enables the covering's adhesive side walls to adhere the inner surfaces of the skirts of a dust ruffle when the dust ruffles is fitted over the fitted covering in place on the box spring. The sides of the covering are drawn into biased abutment against the side walls and end walls of the box spring, thus creating a snug fit covering over box spring. Methods of contouring and elasticizing fitted coverings are well known in the art for making bed linens in which corners are preformed to surround the corner of a mattress or cushion. (See U.S. Classification 5/497).

In other embodiments of the fitted covering of the invention, corner seams are formed in the corners of the covering so as to give the one-piece fitted cover the form of a shallow open box spring when it is fully extended. FIG. 4 shows the inner surface of the dust ruffle detachably attached to the adhesive side walls of the cover. FIG. 1 illustrates in phantom line adhesive panel positioned on side walls of the covering. A dust ruffle is shown fitted over the covering.

Materials

In embodiments of the invention illustrated, the platform section 96 is formed preferably of a textile fabric, such as woven cotton, percale, or the like. The platform section is subject to formation from a variety of flexible sheet materials, such as sheet plastics, needlepunch, or other fibrous surface texture materials, and is dimensioned to extend over the top of a foundation such as a box spring in connection with which the dust ruffle is to be employed.

The covering of the types shown in FIGS. 1-4 are fabricated, utilizing conventional sewing techniques by cutting the components described above, and are preferably of a woven textile fabric or any one of a variety of flexible sheet materials. The components are then assembled as above described utilizing conventional sewing techniques and preferably employing an elasticized thread and/or a shirred stitch to obtain desired elasticity.

The platform 150 and walls 45 may be constructed as continuous sheets of textile or linen material, or alternatively may comprises netted, meshed, webbed or other open structure of varying elasticity.

In certain embodiments, all of portions of the covering is made from mesh, which is material having rows and columns of openings, or diagonally arranged openings, and made of a flexible and, preferably, durable material, which could nevertheless be cut with a pair of scissors. Mesh could be made of plastic.

Still other embodiments involve a platform section which comprises padding. Padded platform embodiments comprise s platform section having several layers of material and a layer of batting integrated within the layers. Construction of padded linen sections is well known in the art (e.g. U.S. Pat. No. 6,823,544, integrated herein by reference).

Embodiments of the covering further comprise those in which the platform and/or side walls comprise flexible, non-slip material made from a friction-enhancing, non-slip material. In certain instances, this material comprises fabric coated with a substance creating a surface with a coefficient of friction sufficient to inhibit, resist, or obstruct slippage between fabric surfaces. In particular, it is contemplated that side walls comprise such non-slip material, the coefficient of friction or stickiness on the outer surface of a side wall sufficient to detachably adhere an inner surface of a bed.

Methods of fabrication using mesh in various combinations and configurations with fabrics and other materials are well known in the art Kasbar National Industries, Inc. Broomall, Pa. 19008; Warm Company, Seattle, Wash.; Mat Concepts, Marlboro, Md.; Hillside Wire Cloth Co., Inc., Belleville, N.J.; McNichols Co., Tampa, Fla.; Herman, R. 1996. Screen Fabrication for Textile Screen Printing. In The Technical Guidebook [CD-ROM], 96 (1). Fairfax, Va.: Screenprinting and Graphic Imaging Association International (SGIA); and various internet sources, e.g. for screen fabrication—http://www.techsolve.org/p2iris/printing/2107-s.htm.

Adherent Side Walls—Sticky Panels

At least the outer surface 180 of the side walls of the covering of the invention comprise adhesive.

In one embodiment, the outer surface 180 of a side wall comprises adhesive panels 40 bonded to the side wall. The adhesive panels are joined such that the adhesive panels constitute a continuous band of adhesive material—a sticky or adhesive strip—which wraps around or circumscribes generally three and in some instances four of the side walls.

The adhesive panels (fasteners) are constructed of either a flexible or rigid material, are sewn , glued or otherwise integral with or bonded to the outer surface of a side wall. Each adhesive panel is provided with a surface which otherwise adheres the inner surface of an adjacently placed section of the skirt. The adhesive panel detachably adheres the complementarily positioned inner surface of the skirt.

Embodiments as illustrated in FIGS. 1-4 illustrate that the covering of the invention includes a sticky strip for extending around at least a portion of the side walls of the covering, which when placed on a box spring, define a perimetrically positioned panel of adhesive fitted to the box spring. Accordingly, the adhesive surface of the side walls releasably secures the skirt portion of a bed skirt to the side walls of the covering, which itself is biasedly fitted to the box spring. The user applies hand pressure to the outer surface of the skirt overlying the sticky panel, thereby forcing the inner surface of the skirt into contact with the sticky surface, thereby releasably securing the inner side of the skirt to the side walls of the covering, which itself is firmly fitted to the box spring.

The panels of adhesive material are secured any distance between the top and bottom edges of a side wall, and parallel to the top edge of the side wall of the covering. In one embodiment, the sticky strip is positioned along the upper portion of the side wall. In certain embodiments, each of the side walls of the covering is provided with a strip of adherent material that extends the entire length of that portion parallel to and just below the upper edge thereof. A strip of adherent material extending substantially the entire length of each side portion of the covering, said strip being spaced from said top edge and being secured to the side sections.

The device can be provided with a plurality of selectively spaced sticky panels rather than the continuously extending components as illustrated. Still other embodiments of the sticky surface comprise discrete, spaced adhesive spots or patches.

With sticky panels bonded into place on the side walls of the covering, a conventional dust ruffle can be installed over the covering of the invention and the inner surface of the skirt can be releasably secured to the side walls of the covering as described above.

A flexible, adhesive panel material which finds use in the invention is Velcro brand tape (Part No. 185198)(Velcro USA Inc., Manchester, N.H.) a two part fastening system, or equivalents in which an adhesive surface is sandwiched between a layer of material which is bonded to the outer surface of a side wall of the covering, and a protective, releaseable strip of paper. The layer of material which is bonded to the outer surface of a side wall can be bonded to the side wall with glue or by sewing the tape to the side wall. After the covering is placed on a box spring, the adhesive surface is exposed by stripping off the protective strip of paper.

It should be understood that formation of an adhesive side panel is not restricted to the above example. Adhesive side sections can be formed by application of spray adhesive to the side sections, or by attachment of fastening tapes to the side sections, or combinations thereof so long as the side sections comprise a sufficient area of adhesivity which enables the engaging of inner sides of a skirt of a bed skirt to the side sections. A wide variety of fastening tapes useful in fabricating the cover of the invention are obtainable from Fastenation, Inc., Passaic, N.J.

It is noted that while a continuous strip of adhesive material is preferred for attachment of the skirts, discontinuous lengths of adhesive material can be employed to provide a continuous effect or to provide spaced apart areas for attachment of the skirt to the side walls. Thus, separate continuous lengths of adhesive material are bonded along the side walls, a sufficient length of adhesive material to substantially adhere the skirt to the side walls.

Although the sticky panels as illustrated herein are linear and parallel to the edges of the side walls, the panels could also be curved or curvilinear, or otherwise shaped and dimensioned in a manner which would still permit the skirt to be releasably secured to the side walls.

Installation of the Device and its Operation

Once the covering of the invention is placed on a foundation, one positions the deck sheeting material of a dust ruffle over the platform section of the covering. The skirt portions are gently press against the sticky panels of the covering's side walls. Repeating such action in a sliding motion along the length of the skirting material attached the skirt to the covering of the invention, thereby stabilizing the position of the dust ruffle.

OPERATION

In use, the covering of the invention serves to stabilize a dust ruffle which may readily be positioned over the covering on a box spring, the dust ruffle held in secure position by virtue of the fitted, contoured, biased, elasticized engagement of the covering with the box spring in connection with which the dust ruffle is employed.

Referring to FIG. 1 the covering-dust ruffle combination of this invention is shown in full assembly about three sides of a conventional box spring.

The skirting section is easily detached from the adhesive side walls by tugging it at an angle to the side wall, whereby the adhesive material and the inner wall of the skirt separate, leaving the covering undisturbed and ready to receive another dust ruffle of different color, pattern or fabric or to receive the dust ruffle which was removed for cleaning.

When the mattress is placed on the box spring over the covering, it is possible to place bedding on the mattress and to tuck the ends thereof between the mattress and the box spring without disturbing the draping of the skirt. When the dust ruffle is positioned with and attached to the covering of the invention, it inherently remains in place, even though the mattress may be slightly shifted, flipped over, or rotated horizontally 180°.

The invention claimed is:

1. A flexible covering for a platform, said covering comprising a. a base section configured and dimensioned for overlaying the top and edges of a foundation;

b. a side section extending from the periphery of the base section, and descending a length adjacent the side of said platform, said length terminating in a lower edge;

wherein an outer surface of said side section comprises an one-part adhesive fastener for removably engaging a corresponding inner side of a skirt of a bed skirt against said one part adhesive fastener of said side section.

2. The covering of claim 1 wherein said platform is selected from the group consisting of boxspring, table, couch, sofa.

3. The covering of claim 1 wherein said platform is a box spring.

4. The covering of claim 1 wherein said side section is dimensioned and adapted to be disposed below the edges of said platform.

5. The covering of claim 4 wherein the lower edge of said side section comprises elastic for biasedly fitting the covering to the platform.

6. The covering of claim 1 wherein said platform section comprises padding.

* * * * *